United States Patent [19]

Abondance et al.

[11] Patent Number: 4,756,544

[45] Date of Patent: Jul. 12, 1988

[54] SKATING-TYPE CROSS-COUNTRY SKI

[75] Inventors: Roger Abondance, Rives; Hubert Nomine, Saint Etienne de Crossey, both of France

[73] Assignee: Skis Rossignol S.A., Voiron, France

[21] Appl. No.: 17,186

[22] Filed: Feb. 19, 1987

[30] Foreign Application Priority Data

Feb. 19, 1986 [FR] France ..... 86 02762

[51] Int. Cl.[4] ..... A63C 5/04

[52] U.S. Cl. ..... 280/609

[58] Field of Search ..... 280/601, 609, 602, 608

[56] References Cited

U.S. PATENT DOCUMENTS 3,212,787 10/1965 Werntz ..... 280/609
4,340,241 7/1982 Crocket ..... 280/609

FOREIGN PATENT DOCUMENTS 1162657 9/1958 France ..... 280/609
39116 of 1907 Switzerland ..... 280/609
161592 7/1933 Switzerland ..... 280/609

*Primary Examiner*—John J. Love
*Assistant Examiner*—Michael Mar
*Attorney, Agent, or Firm*—Karl F. Ross; Herbert Dubno

[57] ABSTRACT

A cross-country ski extending along a longitudinal centerline has a forwardly pointed and tapered shovel, a rearwardly tapered tail, and an intermediate portion extending therebetween and defining a central binding-attachment location. The shovel is at its widest of a relatively great width and the tail is at its widest of a relatively small width substantially smaller than the great width of the shovel. The intermediate portion is comprised of a front intermediate portion flaring smoothly forward from the binding location where it is of the small width to the shovel where it is of the great width and a rear intermediate portion of a constant width equal to the small width and extending between the front portion and the tail.

3 Claims, 1 Drawing Sheet

SKATING-TYPE CROSS-COUNTRY SKI

FIELD OF THE INVENTION

The present invention relates to a cross-country ski. More particularly this invention concerns such a ski particularly suited to the style of cross-country skiing termed "skating."

BACKGROUND OF THE INVENTION

A standard cross country ski has a forwardly tapering and pointed tip or shovel, a rearwardly tapering heel or tail, and a central portion of substantially unchanging transverse width, that is measured perpendicular to the longitudinal centerline of the ski and parallel to its upper and lower faces. Such a ski is typically used with bindings permitting the skier's foot to pivot relative to the ski about one or more axes also perpendicular to the ski centerline and parallel to the horizontal ski faces.

In use such a ski merely follows the tracks of the cross-country trail with the user kicking and poling on alternate sides to propel himself or herself along with the skis always in the tracks and parallel to the travel direction. A modified system uses a ski whose side edges are slightly oppositely concave, that is forming oppositely outwardly open arcs.

Recently however a new style of cross-country skiing termed "skating" has been developed which allows a skier to move on the level and even uphill at a much greater speed than has hitherto been possible. This method, like its namesake sport, entails pushing with one ski at a time, and the pushing ski is angled somewhat to the displacement direction and to the other ski which itself acts purely as support and guide. Thus the skier bites into the snow or ice with the inside edge of one ski and pushes himself along. The skier can alternate each push from one side with a push from the other, or can take a few smaller pushes with one side alternating with a few small pushes with the other side.

In order to adapt standard cross-country skis to this style of skiing, several modifications to the known skis have been suggested, to wit:

The central zone of the ski is made more rigid.

The curve of the ski is changed since any wax or the like used for holding is useless in view of the transverse action of the pushing ski.

The ski is made shorter to increase its maneuverability.

The shovel of the ski is made shorter to lighten the ski and make it easier to recover.

In spite of these modifications normal skis with parallel edges are not well adapted to skating style. At each lateral push the pushing ski slips somewhat between the shovel and the boot, particularly if the snow is hard and frozen as is often the case. This slipping is worse as speed increases and as the surface is icier. Not only does this slipping cut down on maximum speed, an effect that is increased as travel speed increases, but it also can lead to a dangerous fall in situations where the pushing ski kicks out altogether on a very hard push.

Other changes have been made to eliminate this effect, namely:

The ski is made to be very square over a portion of its length.

A metallic reinforcing plate is provided in the ski to rigidify it and serve as gripping edge.

Longitudinal grooves are formed that extend along the ski.

The ski is made more resistant to torsional deformation.

Finally the ski has been redimensioned so it is in one system 44 mm wide in the center, 46 mm at the shovel, and 45 mm at the tail, and in another system it is 44 mm at the shovel, 46 mm at the boot in the center, and 42 at the tail.

None of these modifications produces a ski suitable for skating with limited slipping of the front end and good maneuverability.

OBJECTS OF THE INVENTION

It is therefore an object of the present invention to provide an improved cross-country ski particularly adapted to skating.

Another object is the provision of such a cross-country ski particularly adapted to skating which overcomes the above-given disadvantages, that is which has good hold at the front end and that is easy to guide.

SUMMARY OF THE INVENTION

A cross-country ski extending along a longitudinal centerline has a forwardly pointed and tapered shovel, a rearwardly tapered tail, and an intermediate portion extending therebetween and defining a central binding-attachment location. The shovel is at its widest of a relatively great width and the tail is at its widest of a relatively small width substantially smaller than the great width of the shovel. According to the invention the intermediate portion is comprised of a front intermediate portion flaring smoothly forward from the binding location where it is of the small width to the shovel where it is of the great width and a rear intermediate portion of a constant width equal to the small width and extending between the front portion and the tail.

This shape gives the ski excellent hold when used for skating. In particular the straight edges of the rear intermediate portion bite into the snow or ice very well, with minimal slippage. Similarly the wide front portion gives a very good hold at the moment of push while making change of direction particularly easy. This ski is particularly adapted for relatively fast skating-style skiing even on relatively hard snow.

According to this invention the tail has at its rearmost end a width equal to between 15 mm and 25 mm, the small width of the widest part of the tail and of the entire rear intermediate portion is between 43 mm and 46 mm, and the great width of the widest part of the shovel and of the front intermediate portion is between 45 mm and 50 mm. In addition the longitudinal length of the tail is between 100 mm and 200 mm, the longitudinal length of the the tail together with the rear intermediate portion is between 500 mm and 700 mm, the length of the shovel parallel to the centerline is between 100 mm and 250 mm, and the length of the front intermediate portion is determined by the overall ski length.

The shovel is at its widest where it joins the front intermediate portion and the frontmost region of the front intermediate portion is of the great width. The rear intermediate portion joins the front intermediate portion behind the binding location.

DESCRIPTION OF THE DRAWING

The above and other features and advantages will become more readily apparent from the following, reference being made to the accompanying drawing in which.

SPECIFIC DESCRIPTION

Figure 1:
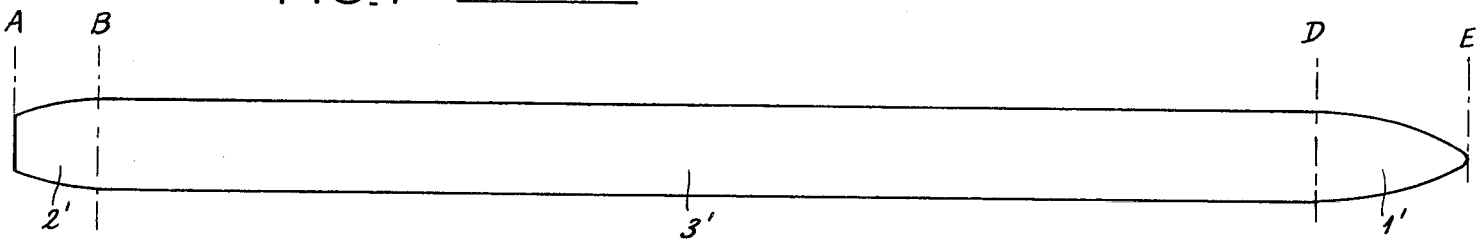
FIG. 1 PRIOR ART
FIG. 1 is a top view of a prior-art cross-country ski.

As seen in FIG. 1 a standard prior-art cross-country ski extends along a centerline L and has a front tip 1', a rear heel 2', and a central portion 3'. The heel 2' is defined between a rear-end plane A perpendicular to the line L and a plane B parallel thereto and forward therefrom by a distance equal to about one-twentieth of the length of the ski and tapers smoothly from the plane A to the plane B. The tip 1' is defined between a front-end plane E and a plane D parallel thereto and rearward therefrom by a distance equal to about one-tenth the length of the ski and tapers smoothly from the plane E to the plane D. The central portion 3' is of unchanging and continuous width.

Figure 2:
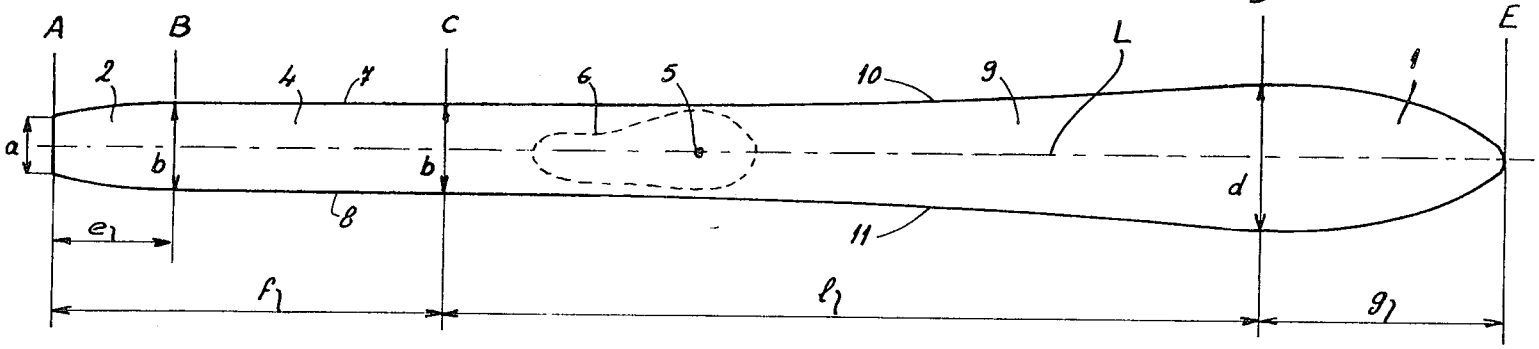
FIG. 2 is a top view of a cross-country ski according to this invention.

As seen in FIG. 2 the ski of this invention basically comprises a shovel or tip 1, a heel or tail 2, a rear intermediate portion 4, and a front intermediate portion 9, the latter two being joined at a plane C somewhat behind the location 6 for the ski binding although this plane C could move forward to the point 5 where the skier's foot pivots on its ball at the metatarso-phalangial joint. The heel 2 flares forward, that is toward the tip 1, from a very small width a to a larger but still small width b. The entire rear portion r is of this width b, that is its side edges 7 and 8 are parallel. The front intermediate portion 9 flares forward from the width b at the plane C to a substantially greater width d where it joins the shovel 1 at the plane D so its side edges 10 and 11 diverge toward the front. This shovel 1 in turn is of the great width d in its rearmost portion and tapers to a rounded point at the plane E. The shovel 1 not only includes the, turned-up tip of the ski but also the wide part that connects it to the intermediate portion 9.

According to this invention the width a of the tail 2 has at its rearmost end at the plane A is equal to between 15 mm and 25 mm, the small width b of the widest part of the tail 2 and of the entire rear intermediate portion 4 is between 43 mm and 46 mm, and the great width d of the widest part of the shovel and of the front intermediate portion is between 45 mm and 50 mm.

In addition:

the longitudinal length e of the tail 2 between the planes A and B is between 100 mm and 200 mm, the longitudinal length f of the the tail 2 together with the rear intermediate portion 4 between the planes A and C is between 500 mm and 700 mm, the length g of the shovel parallel to the centerline L between the planes D and E is between 100 mm and 250 mm, and the length l of the front intermediate portion between the planes C and D is determined by the overall ski length.

Thus one specific example of a ski according to this invention has the following dimensions:

a=21 mm
b=43 mm
d=48 mm
e=150 mm
f=550 mm
l=1170 mm
g=280 mm.

This ski has a rectified length of 2 m, with a length parallel to the centerline L equal to 1.92 m.

We claim:

1. In a cross-country ski extending along a longitudinal centerline and having a forwardly pointed and tapered shovel, a rearwardly tapered tail, and an intermediate portion extending therebetween and defining a centrally positioned binding-attachment location normally underlying the skier's foot, the improvement wherein the shovel is at its widest of a relatively great width of between 45 mm and 50 mm;

the tail is at its widest of a relatively small width of between 43 mm and 46 mm and being substantially smaller than the great width of the shovel and having at it's rearmost end a width of between 15 mm and 25 mm; and the intermediate portion is comprised of a front intermediate portion flaring smoothly forward with outwardly diverging side edges from a point on the ski at said binding-attachment location where it is of the small width to the shovel where it is of the great width, and a rear intermediate portion of a constant width equal to the small width and extending between the front intermediate portion and the tail, said ski having substantially parallel side edges extending from said centrally positioned binding-attachment location on said front intermediate portion to the rearmost end of said rear intermediate portion.

2. The cross-country ski defined in claim 1 wherein:

the longitudinal length of the tail is between 100 mm and 200 mm, the longitudinal length of the the tail together with the rear intermediate portion is between 500 mm and 700 mm and, the length of the shovel parallel to the centerline is between 100 mm and 250 mm.

3. The cross-country ski defined in claim 1 wherein said rear end of said said front intermediate portion lies in a plane whose forwardmost location is coincident with a point of said central binding-attachment location at which a skier's foot at said central binding-attachment location pivots on its ball at the metatarso-phalangial joint.

* * * * *